US005543764A

United States Patent [19]

Turunen et al.

[11] Patent Number: 5,543,764

[45] Date of Patent: Aug. 6, 1996

[54] FILTER HAVING AN ELECTROMAGNETICALLY TUNABLE TRANSMISSION ZERO

[75] Inventors: Aimo Turunen; Heli Jantunen, both of Oulu, Finland

[73] Assignee: LK-Products Oy, Kempele, Finland

[21] Appl. No.: 202,902

[22] Filed: Feb. 28, 1994

[30] Foreign Application Priority Data

Mar. 3, 1993 [FI] Finland ..... 930943

[51] Int. Cl.[6] ..... H01P 1/201

[52] U.S. Cl. ..... 333/202; 333/205; 333/207

[58] Field of Search ..... 333/202–207, 333/174–176

[56] References Cited

U.S. PATENT DOCUMENTS

| | | | |
|---|---|---|---|
| 4,418,324 | 11/1983 | Higgins | 333/204 |
| 4,536,725 | 8/1985 | Hübler | 333/204 |
| 5,138,288 | 8/1992 | Blackburn | 333/202 |
| 5,227,748 | 7/1993 | Sroka | 333/207 |

FOREIGN PATENT DOCUMENTS

| | | | |
|---|---|---|---|
| 0285503 | 10/1988 | European Pat. Off. . | |
| 0346672A3 | 5/1989 | European Pat. Off. . | |
| 0520641A1 | 9/1992 | European Pat. Off. . | |
| 62-233901 | 10/1987 | Japan . | |
| 2020908 | 1/1990 | Japan . | |
| 0000718 | 1/1993 | WIPO | 333/204 |

*Primary Examiner*—Benny Lee
*Attorney, Agent, or Firm*—Darby & Darby, P.C.

[57] ABSTRACT

A transmission line filter comprises four resonators (100, 200, 300, 400), and transmission zeroes can be added to the transfer function of the filter using a known phasing coupling technique using a transmission line (53, 54) coupled between two resonators. The location of the transmission zeroes can be varied using control circuits (A,B). Each control circuit comprises a series coupled inductance (55, 58) and capacitance (56, 59) forming a resonance circuit, the resonance frequency of which can be varied using a variable d.c. voltage ($V_1$, $V_2$). The inductance of each control circuit is arranged adjacent its respective transmission line so that the two are weakly electromagnetically coupled. By supplying the variable voltage to the resonance circuits, normal operation of the phasing coupling is affected, thereby varying the location of the transmission zero. One or more control circuits can be provided for filters having transmission zeroes in their transfer function which need to be varied. The provision of these control circuits allow transmission zeroes to be selected in situ, rather than solely during manufacture.

13 Claims, 4 Drawing Sheets

FILTER HAVING AN ELECTROMAGNETICALLY TUNABLE TRANSMISSION ZERO

The present invention relates to a filter comprising at least a first resonator and a second resonator and a transmission zero means coupled between the first and second resonators to provide a transmission zero in the transfer function of the filter.

BACKGROUND OF THE INVENTION

In data communication technology, the need often arises whereby a greater attenuation in certain stop band frequencies of a passband filter is required than what is achievable using a conventional passband filter. One such example is the filter used in the front end of a radio telephone. As is well known to persons skilled in the art in a radio telephone a received radio frequency signal is mixed, after the front end filter, which may be, for example, the receiver branch of a duplex filter, in a mixer with a signal from a local oscillator (LO) to provide an intermediate frequency (IF) signal. The frequency of the local oscillator signal is offset by the intermediate frequency from the frequency of the received signal. In a mixer the resultant output signals are the sum and difference of the local oscillator and received signal frequencies, with the undesirable frequencies produced being filtered out in an intermediate frequency filter so that only signals of the desired frequency remain. Thus, when employing a mixer no difference can be made between a desired received signal and a signal having the mirror (or image) frequency, the image frequency being that frequency which differs from the local oscillator (LO) frequency by the IF, but at the other side of the LO frequency from the received signal. As an example, let the local oscillator frequency be A MHz and the desired received signal frequency B MHz, this being greater than the A MHz. The intermediate frequency (IF) obtained as a result of the mixing is the difference between these frequencies, i.e. IF=(B-A) MHz. There is also the so-called image frequency which, as described above, is smaller than the LO frequency by the magnitude of the IF, so that if a signal having the image frequency C MHz is mixed with the LO signal, an IF signal having a frequency IF=(A-C) MHz results, which is the same as (B-A) MHz. This is illustrated in FIG. 2. The IF filter is not capable of distinguishing between the frequencies (B-A) and (A-C), although only the signal of frequency (B-A) is wanted. Because of this, the image frequency signal C has to be filtered in the front end filter before the mixer, so that it will not be coupled to the mixer, and only the signal of frequency B (which contains the required information) is shifted to the intermediate frequency.

This filtering is achieved using a bandpass filter, but unfortunately, the requirements for such a filter are mutually contradictory. The attenuation of the passband filter is required to be low at the desired signal frequency (frequency B) but it must be able to attenuate strongly the undesirable image-frequency signal (frequency C) usually located in the proximity of the 3 dB limit frequency of the filter. Widening the passband reduces the transmission losses of the filter while simultaneously reducing also the attenuation in the mirror frequency. These contradictory requirements have been solved by adding one or more additional transmission zeroes to the transfer function of the filter, the zeroes being located at the frequency of the undesirable signal (frequency C). Adding a transmission zero can be done by means of a separate parallel resonator, or using a so-called phasing technique within the filter.

This principle of adding transmission zeroes using the phasing technique is described in the patent No. U.S. Pat. No. 4,418,324 and it is summarized below with reference to the accompanying FIGS. 1 and 2. A passband filter includes four adjacent quarter wavelength resonators 1,2,3,4, one end of each resonator being grounded. The resonators 1,2,3,4 are strip-line resonators arranged interdigitally although it is obvious to a person skilled in the art that resonators of other types may be used. The coupling between the resonators is electromagnetic, coupling across-depending on the structure of the filter-air (in a helix resonator), an insulation plate (in microstrip and strip-fine resonators), or a ceramic plate (in a ceramic resonator), and the intensity of the coupling is dependent on the distance between the resonators. The input of a signal to the first resonator 1 and the output of the signal from the last resonator 4 can be carded out e.g. by tapping as is known to a person skilled in the art. As is also known to a person skilled in the art, each resonator 1,2,3,4 determines one pole in the transmission function so that a desired passband filter can be constructed by varying the structure. A first transmission zero of the transfer function is produced by coupling a conductive line or conductive channel between the open ends of two non-adjacent resonators 1 and 3, the transmission line or conductive channel comprising, a controllable capacitance 6, a transmission line 5, and a second controllable capacitance 7 coupled in series. A second transmission zero may be similarly produced by coupling a second conductive transmission line or conductive channel between the open ends of the other set of nonadjacent resonators 2 and 4. The second conductive transmission line or channel similarly consisting of a controllable capacitance 9, a transmission fine 8, and a second controllable capacitance 10 coupled in series. In this way a reverse-phased component is coupled to the resonator, and dependent on the amplitude a given additional attenuation can be provided in a given point of the frequency curve.

In the above-mentioned patent, interdigitally arranged resonator strips are located between two insulator plates, with the grounded surfaces being located on the other side of the plates from the resonator strips (i.e. a strip-line structure). On one of the grounded surfaces, the conductive channels are provided by transmission strips (produced by etching on the grounded surface), which have widened ends or pads arranged to be adjacent the open or non-grounded, ends of two non-adjacent resonators 1,2,3,4 located on the opposite side of the insulator plate. Each pad forms a parallel plate capacitor with the open ends of the resonators. By changing the sizes of the widened ends the capacitances can be changed and thus, the locations of the transmission zeroes can be separately and precisely selected as desired. The transmission zeroes may also be placed one on top of the other, whereby an extremely high attenuation can be produced for the frequency in the attenuation curve of the filter.

FIG. 2 shows graphically the impact of the addition of transmission zeroes. The broken line curve illustrates the frequency response of the filter when no transmission zeroes have been added. A signal B at the received frequency passes through the filter without becoming essentially attenuated, whereas a signal at mirror frequency C is not sufficiently attenuated. By adding at least one transmission zero in the mirror frequency C, the frequency can be attenuated further without exerting any influence on the attenuation of the pass frequency B proper, this being shown in curve d. The addition of a transmission zero slightly weakens the attenuation also at the upper end of the attenuation curve, but the drawback is fairly insignificant in the present application. A transmission zero may also be added above the frequency B when wishing to have a "recess" at this point of the attenuation curve.

The transmission line produces a reverse-phased component at a desired frequency in the attenuation curve, the amplitude determining the additional attenuation to be produced at that point. Hereby, a transmission zero point is generated at this point of the attenuation curve.

In practice, the supplier of the filter sets the location of the transmission zero by reducing the widened ends by means of a laser or by removing material, whereafter no further setting is done. The setting may, at least in certain practical designs, be accomplished by means of controllable capacitances.

The prior art methods of setting the transmission zero involve a variety of drawbacks. Firstly, the transmission zero is frequently selected in the manufacturing phase as described above, and setting it may turn out to be difficult as it requires the removal of material with laser or by grinding. Secondly, if one manages to produce the capacitors 6,7,9 and 10 so that the selecting of the transmission zero is possible after the manufacturing, the power travelling through the transmission line will cause problems with regard to the duration of the power of the adjusting capacitor. Such drawbacks may, in fact, be removed by abandoning the transmission lines, and by adding, instead, parallel resonators in the filter, though this will impair the Q value of the filter.

SUMMARY OF THE INVENTION

According to an aspect of the invention there is provided a filter which further comprises control means electromagnetically coupled to the transmission zero means for selecting the frequency of the transmission zero. This has the advantage of allowing the location of the transmission zero i.e. its frequency, to be selected in situ rather than at manufacture, and in a substantially smooth manner.

The control means may be a resonance circuit comprising an inductance and a capacitance and having a variable resonance frequency. The transmission zero means may also comprise an inductance and at least one capacitance coupled thereto to provide a second resonance circuit having a second resonance frequency. The two inductances may be arranged so that they are weakly electromagnetically coupled whereby as the control means resonance frequency is adjusted the normal operation of the second resonance circuit is affected and, consequently, the transmission zero frequency is varied. This has the advantage that the control means requires little power from the filter and, therefore, no special power capacity requirements need to be set for the components of the control circuit (which may be an inductance or a capacitance). Because only that part of the filter in which low power travels is affected, that part in which the great powers are transmitted is not affected. The resonators do not become loaded, and therefore, the passband of the filter remains unchanged. The Q value of the filter is good. Since the coupling with the conductive transmission line is very weak, the power of the control means is small as well. Dimensioning the control means is easier and inexpensive capacitance diodes can be used.

BRIEF DESCRIPTION OF THE DRAWINGS

The invention will now be described by way of example only with reference to the accompanying figures, of which.

DETAILED DESCRIPTION OF THE PREFERRED EMBODIMENT

Figure 1:
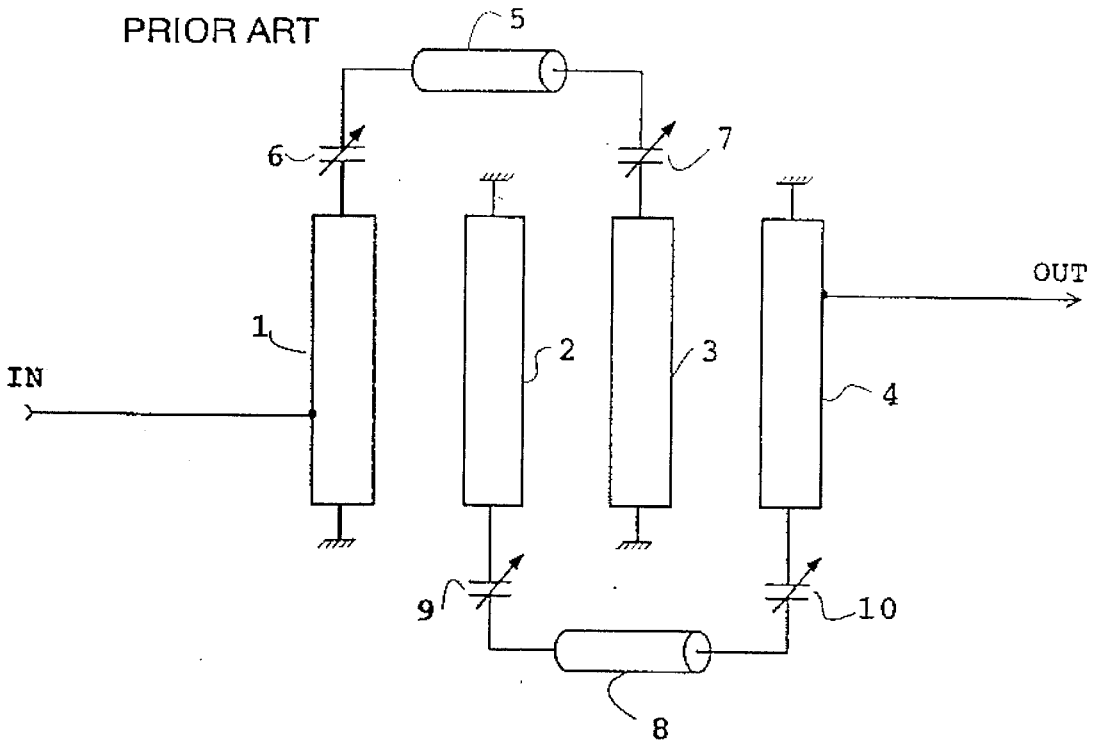
FIG. 1 illustrates, schematically, a filter of the prior art with a tunable transmission zero.
Figure 2:
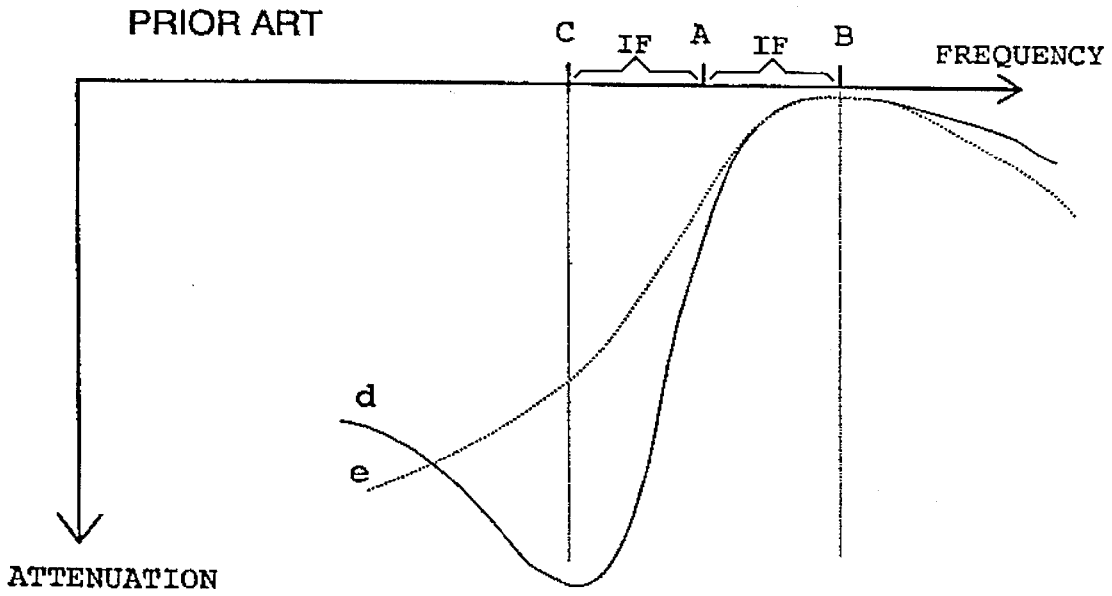
FIG. 2 shows the effect of the transmission zero in the attenuation curve of the filter of FIG. 1.

FIGS. 1 and 2 have already been discussed above in relation to the prior art.

Figure 3:
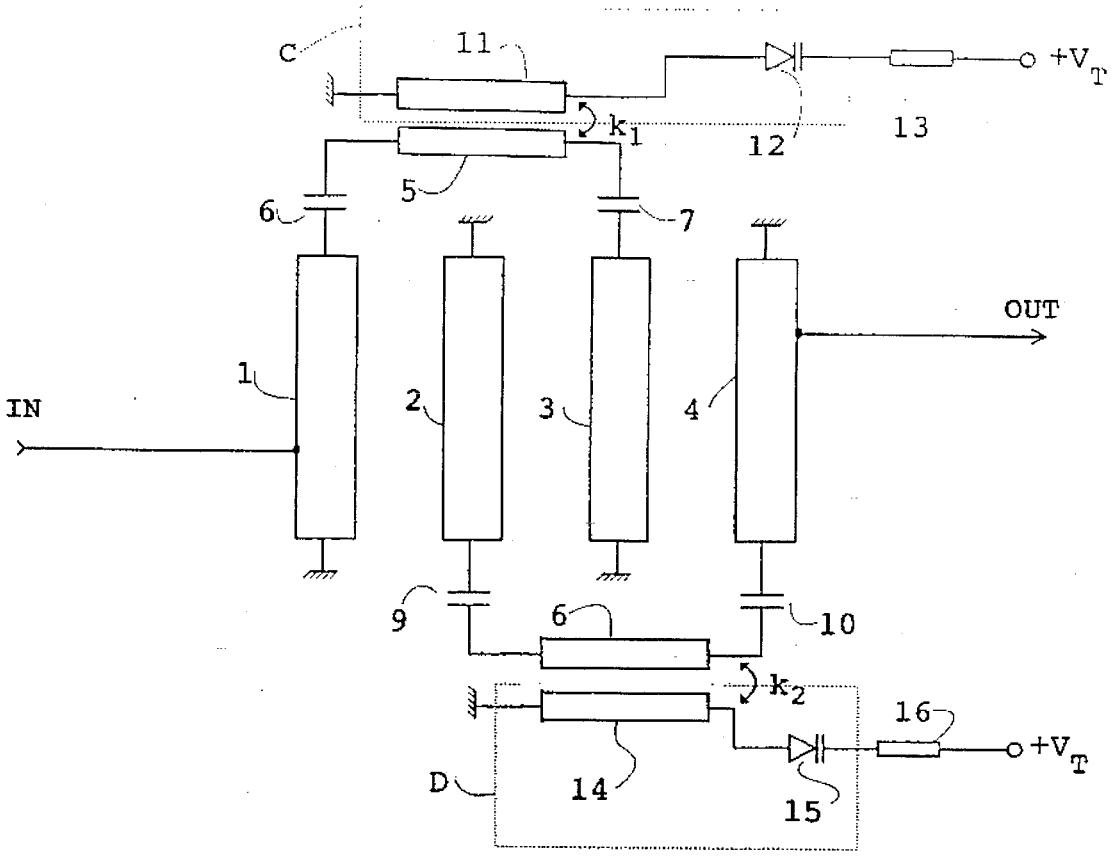
FIG. 3 illustrates, schematically, a filter in accordance with the present invention.

In FIG. 3, those components equivalent to those described with reference to FIG. 1 are designated with the same reference numerals.

The filter of FIG. 3 is substantially the same as that of FIG. 2, except that the capacitances 6, 7, 9, 10 of the conductive transmission lines are not variable, and, additionally, control circuits C,D have been added, the purpose of which is described below.

Adjacent to the transmission lines 5 and 8 used to produce transmission zeroes, as discussed above, i.e. of the phasing coupling there are provided the control circuits C and D respectively. These are resonance circuits, comprising transmission lines 11, and 14 respectively arranged in parallel with and positioned at a distance from the respective transmission lines 5 and 8, so that the electromagnetic coupling k1, k2, between the respective pairs of adjacent transmission lines 5,11; 8,14 is rather weak. In this way, the energy transmitted from the transmission lines 5 and 8 to the respective adjacent transmission lines 11 and 14 of the interference circuits C,D is insignificant, and therefore, the control circuits C and D, including the transmission lines 11 and 14, can be dimensioned to be low in power.

Each control circuit C,D includes, together with the transmission line 11, 14 respectively, a series coupled controllable capacitance, in the example described herein this being a capacitance diode 12, and 15 respectively. The capacitances of both capacitance diodes 12, 15 are controlled by a direct voltage $V_T$ coupled via a resistor 13, 16. The circuit supplying the direct voltage $V_T$ has been AC isolated from the resonance circuit C,D. The isolation can be carried out in the supply circuit or the resistors 13 and 16 can be replaced by high inductances. Each control circuit C,D is thus a resonance circuit provided by series connection of an inductance and a capacitance, i.e. the transmission line 11, 14 and the capacitance diode 12, 15, the resonance frequency of which is tuneable by means of an external direct voltage $V_T$.

The requirements set for the diodes are not very high. As a rough estimate, one may assume that when about 1/1000 of the filter power passes through the transmission lines 5 and 8, about 1/10 of this power, i.e. 1/10000 of the filter power, transmits to the control circuits C,D. The coupling coefficients k1 and k2 would in such an instance be 0.1.

Figure 4:
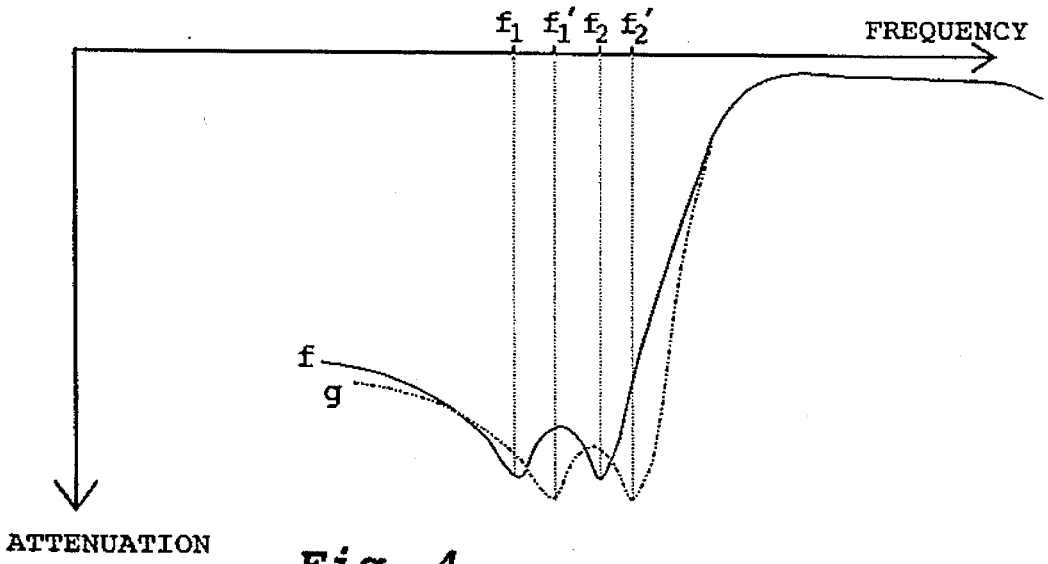
FIG. 4 illustrates the frequency response of the filter of FIG. 3.

The control circuits C,D are used to select the transmission zeroes in the manner described below. When no control direct voltage $V_T$ is supplied, i.e. when the control circuit C,D is not in operation, the conductive transmission line 8, 9, 10; 5, 6, 7 will produce the phase difference of a signal passing through the conductive transmission line 8, 9, 10; 5, 6, 7 i.e using the phasing coupling technique as described above with reference to the prior art and, as is well known to persons skilled in the art and this will be determined by the components thereof. In this case, the control circuit C,D exerts hardly any effect on the production of the transmission zeroes and the frequency response of the filter is similar to curve f of FIG. 4, with the transmission zeroes at frequencies $f_1$ and $f_2$. Now, when a control direct voltage $V_T$ is coupled to the control circuits C,D, providing a capacitance value for the diodes 12 and 15 such that the resonance frequencies of the control circuits C, D approach the resonance frequencies of the respective conductive transmission lines 8, 9, 10; 5, 6, 7 coupled thereto, then power will be transmitted from the transmission lines 5,8 to the control circuits C,D, so that the normal operation of the conductive transmission line is affected and the phase difference produced in the conductive transmission line 8, 9, 10; 5, 6, 7 is altered whereby the frequency response of the filter is such that the location of the transmission zeroes is changed. This is illustrated in FIG. 4, where the first transmission zero has shifted from frequency $f_1$ to frequency $f'_1$, and the second transmission zero has shifted from frequency $f_2$ to frequency $f'_2$. The frequency response has thus been changed in the stop band, now complying with curve g. By changing the control voltage $V_T$, the location of the transmission zeroes can be changed in a given frequency range and may be done substantially smoothly.

By using a different control voltage $V_T$ for each interference circuit C and D, the location transmission zeroes can be shifted independently of one another.

Figure 5:
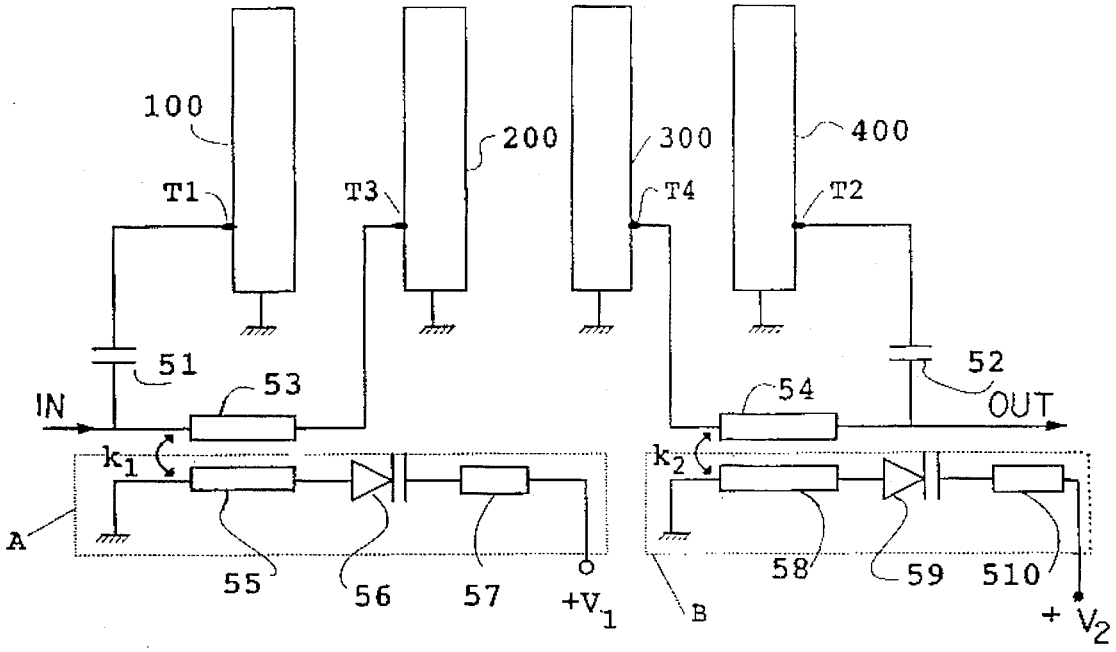
FIG. 5 illustrates, schematically shows a four resonator passband filter provided with two controllable transmission zeroes in accordance with the invention.

FIG. 5 illustrates a four resonator passband filter in which the phasing coupling of the transmission zeroes slightly differs from the coupling in FIG. 1. The coupling is, as such, already known to persons skilled in the art. The filter comprises four resonators 100,200,300 and 400, which may be of any prior art type, e.g. helix, ceramic, stripline, or microstrip resonators. An input signal is coupled to the first resonator 100 e.g. by tapping at $T_1$, and an output signal for the filter is provided from the last resonator 400 at the tapping point $T_2$. When matching the input and output signals, capacitances 51 and 52 are used, this also being known to persons skilled in the art.

The input signal is also coupled, attenuated, to a second resonator 200 by tapping at $T_3$. The signal is attenuated in an inductance 53 by the order of magnitude 1/100 and, additionally the phase is also changed. Similarly, the output signal is also coupled, attenuated, to a third resonator 300 by tapping at $T_4$. Before being coupled to the third resonator 3, the output signal is attenuated in an inductance 54 by the order of magnitude 1/100, and the phase is also changed. By means of the two phasing couplings thus produced, two transmission zeroes are produced at a desired frequency. The location of the transmission zeroes is therefore completely determined by the coupling, and is therefore fixed. This is known to a person skilled in the art.

By providing a first control circuit A, the location of the first transmission zero can be changed substantially smoothly in a given frequency range by affecting the signal passing through the inductance 53 in the input phasing circuit with the control circuit A. This is achieved by providing an inductance 55 of the control circuit A in the field of the inductance 53 so that the coupling coefficient $k_1$ between the two inductances 53,55 is quite small, e.g. 0.1, such that about one tenth of the power of the inductance 53 is coupled to the control circuit A. The inductance 55, with one of its ends being grounded and a capacitance 56 coupled to its other end constitute a series resonance circuit the resonance frequency of which is changeable by changing a control voltage $V_1$ coupled to the cathode of the capacitance 56 (in the present example, a capacitance diode) through resistor 57. By changing the resonance frequency of the control circuit A, the phase and amplitude of the signal entering the tapping point $T_3$ of the phasing circuit is changed, and this change can be seen as a displacement of the transmission zero in the frequency curve.

Similarly, a signal travelling through the inductance 54 of the phasing coupling circuit at the output side of the filter is affected using a second control circuit B. The coupling coefficient between an inductance 58 of the control circuit B and the inductance 54 is $k_2$. The inductance 58, one end of which is grounded, and a capacitance 59 (in this example, a capacitance diode), which is coupled to the ungrounded end of the inductance 58 constitute a series resonance circuit, the resonance frequency of which may be changed by means of a control voltage $V_2$ coupled to the cathode of the capacitance diode 59 via a resistor 510. By changing the resonance frequency of the second control circuit B, the phase and amplitude of the signal entering the tapping point $T_4$ of said phasing circuit can be changed and the change can be seen as a displacement of said second transmission zero in the frequency curve.

Figure 6:
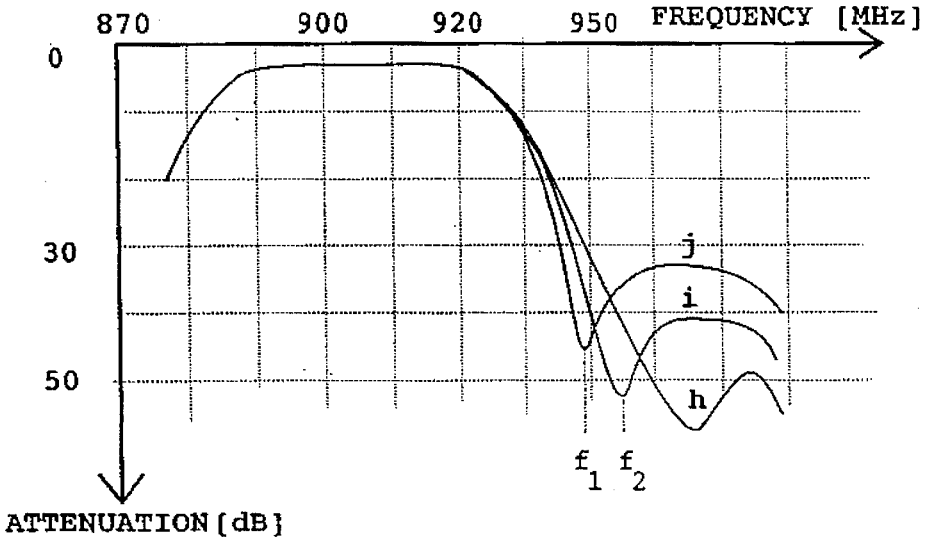
FIG. 6 illustrates the frequency response of the filter of FIG. 5.

The frequency response of the filter illustrated in FIG. 5 is shown in FIG. 6. The passband of the filter is about 890 to 920 MHz. On both sides of the passband, there is an extra attenuation in the stop band produced by the transmission zero. In FIG. 6, the transmission zero located above the passband is examined. Curve h illustrates the frequency response of a filter with no transmission zeroes. At frequency $f_2$ the attenuation is 40 dB. At that point, more attenuation is desired, so a transmission zero is produced at that frequency by means of the prior art phasing coupling discussed above. Now, the frequency response is illustrated by curve i. If, in an application, the frequency $f_1$ needs to be particularly attenuated, the 35 dB attenuation of curve i will be insufficient and, therefore, the phasing coupling is affected using the control circuit described above i.e. the normal operation of the filter is affected because of the weak electromagnetic coupling between the adjacent transmission lines 54,58. The attenuation at this frequency will now be 43 dB, as shown by curve j.

As will be understood to a person skilled in the art, and an arrangement from the curves, the control circuits can also be used for making the frequency response steeper while moving from the pass band to the stop band. This is highly advantageous since the steepness of the frequency response of a filter is frequently a most desirable property. The pass band of the filter remains unchanged in the course of the measures accomplished.

Figure 7:
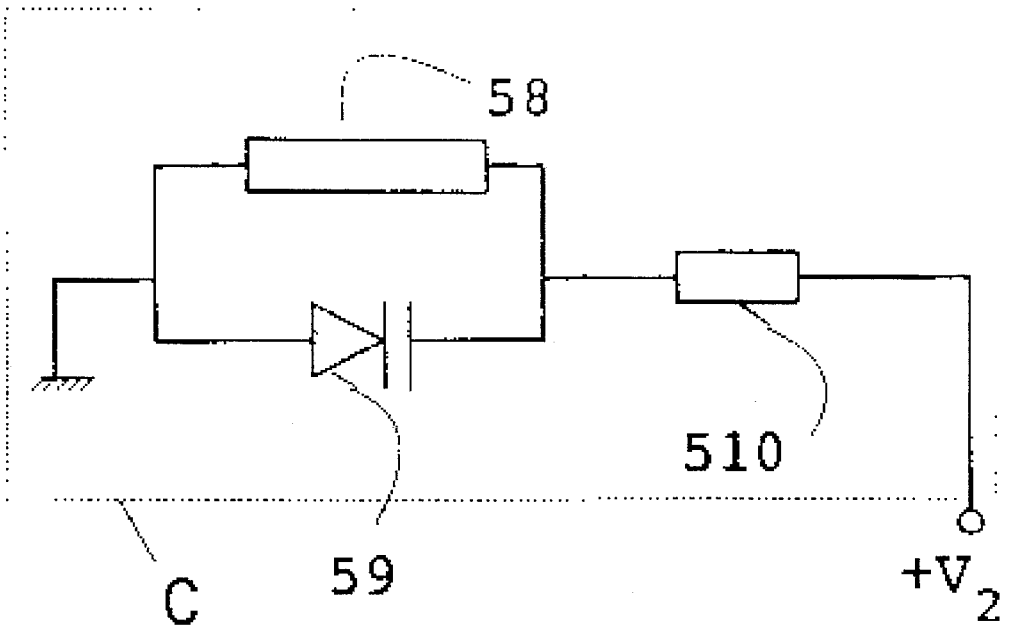
FIG. 7 illustrates a parallel resonance control circuit.

As will be understood by a person skilled in the art, modifications are possible within the scope of the present invention, for example, no limitations exist for the filter type, e.g. helical, stripline, microstrip or dielectric may be used as may other zero transmission means circuits. The only essential feature is that the signal travelling through the conductive transmission line is affected by an external control circuit. The control circuit may also be implemented in ways other than those described above. It can be a parallel resonance circuit in which the resonant frequency is controlled by a direct voltage applied across the capacitance diode. An example of a parallel resonance control circuit is shown in FIG. 7, designated generally by "C". Resonance control C illustrates a parallel resonance circuit including inductance 58 coupled in parallel with capacitance diode 59 which are respectively coupled in series with resistor 510 which is in turn coupled to control voltage $+V_2$. Control circuit C may be utilized in the present invention, e.g., instead of control circuit B. With regard to the control circuit, the only requirement is that a change in the electrical property of the control circuit leads to a controlled change in the conductive transmission line of the filter producing a transmission zero. The number of control circuits can also be varied—from a single control circuit to two or more as required, depending upon how many transmission zeroes need to be selected.

We claim:

1. A filter having a transfer function and comprising:

at least a first resonator and a second resonator;

a transmission zero means coupled between the first and second resonators to provide a transmission zero at a frequency in the transfer function of the filter; and control means electromagnetically coupled to the transmission zero means for changing and selecting the frequency of the transmission zero.

2. A filter according to claim 1, wherein the control means is a resonance circuit comprising an inductance and a capacitance coupled thereto and having an adjustable resonance frequency whereby adjustment of the resonance frequency allows selection of the transmission zero frequency.

3. A filter according to claim 2 wherein the transmission zero means comprises at least an inductance arranged to be in weak electromagnetic coupling with the respective inductance of the control means such that normal operation of the transmission zero means is affected in response to the adjustment of the control means resonance frequency thereby varying the transmission zero frequency.

4. A filter according to claim 3, wherein the transmission zero means is a second resonance circuit having a second resonance frequency comprising the inductance and at least one capacitance coupled thereto, whereby, as said control means resonance frequency is adjusted to approach the second resonance frequency, the normal operation of the second resonance circuit is affected in response to the adjustment thereby varying the transmission zero frequency.

5. A filter according to claim 2, wherein the capacitance of the control means is a variable capacitance whose value is variable under control of a variable d.c voltage applied thereto to vary the resonance frequency of the control means.

6. A filter according to claim 5, wherein the variable capacitance is a capacitance diode.

7. A filter according to claim 5, wherein the variable capacitance and the inductance of the control means are coupled in series.

8. A filter according to claim 5, wherein the variable capacitance and the inductance of the control means are coupled in parallel.

9. A filter having a transfer function and comprising:

at least three resonators arranged in a row substantially adjacent one another and electromagnetically coupled to each other, each resonator having a grounded end and an ungrounded end;

transmission zero means coupled between the ungrounded ends of two adjacent ones of said resonators to provide a transmission zero at a frequency in the transfer function of the filter; and control means electromagnetically coupled to the transmission zero means for changing and selecting the frequency of the transmission zero.

10. A filter having a transfer function and comprising:

at least three resonators arranged in a row substantially adjacent one another and electromagnetically coupled to each other, each resonator having a grounded end and an ungrounded end;

transmission zero means coupled between the ungrounded ends of two non-adjacent ones of said resonators to provide a transmission zero at a frequency in the transfer function of the filter; and control means electromagnetically coupled to the transmission zero means for changing and selecting the frequency of the transmission zero.

11. A filter having a transfer function and comprising:

a first pair of resonators;

a second pair of resonators electromagnetically coupled to the first pair of resonators;

a first transmission zero means coupled between the resonators of the first pair of resonators to provide a first transmission zero at a first frequency in the transfer function of the filter;

a first control means electromagnetically coupled to the first transmission zero means for changing and selecting the first frequency of the first transmission zero;

a second transmission zero means coupled between the resonators of the second pair of resonators to provide a second transmission zero at a second frequency in the transfer function of the filter; and a second control means electromagnetically coupled to the second transmission zero means for changing and selecting the second frequency of the second transmission zero.

12. A filter according to claim 11, wherein the at least first and second control means are a single control means.

13. A filter according to claim 11, wherein the at least first and second control means are controllable independently of one another.

* * * * *